United States Patent [19]

Hogue et al.

[11] Patent Number: 5,050,329

[45] Date of Patent: Sep. 24, 1991

[54] TWO-PIECE HANDGRIP FOR HAND GUN

[75] Inventors: Aaron G. Hogue; Patrick L. Hogue, both of Atascadero, Calif.

[73] Assignee: Hogue Grips, Atascadero, Calif.

[21] Appl. No.: 663,476

[22] Filed: Mar. 4, 1991

[51] Int. Cl.[5] ..... F41C 23/14

[52] U.S. Cl. ..... 42/71.02

[58] Field of Search ..... 42/7, 71.02

[56] References Cited

U.S. PATENT DOCUMENTS

| | | | |
|---|---|---|---|
| 2,117,826 | 5/1938 | Seidel | 42/7 |
| 4,520,585 | 6/1985 | Barrett | 42/7 |
| 4,570,370 | 2/1986 | Smith et al. | 42/7 |
| 4,593,487 | 6/1986 | Ruger et al. | 42/7 |
| 4,936,036 | 6/1990 | Sniezak et al. | 42/71.02 |

*Primary Examiner*—Richard W. Wendtland

*Attorney, Agent, or Firm*—Daniel C. McKown

[57] ABSTRACT

An accessory that permits replacement of the factory-supplied one-piece standard plastic handgrip by a personally selected or customized two-piece handgrip consists of a block having a laterally-extending hole sized to accept a laterally extending pin used for retaining the block to the frame of the hand gun and further includes laterally-extending threaded holes for receiving screws that are used for securing the two pieces of the personally-selected two-piece handgrip to the frame of the gun.

2 Claims, 2 Drawing Sheets

TWO-PIECE HANDGRIP FOR HAND GUN

BACKGROUND OF THE INVENTION

The Prior Art

The present invention is specifically for use with a particular make and model of hand gun that has proven to be very popular.

Not withstanding the popularity of this hand gun, many purchasers of it wish to personalize the hand gun by replacing the factory-supplied handgrip by a more distinctive, functional, or aesthetically-pleasing handgrip of their own choosing. The grip supplied by the factory consists of a serviceable molded plastic part of a neutral color. Many purchasers of the hand gun would prefer more decorative grips of their own choosing and of materials ranging from fine wood to bone or ivory, or rubber, and perhaps distinctively carved.

Because of the design of the factory-supplied handgrip, and the manner in which it is attached to the frame of the gun, there was no feasible way of attaching the two halves of a two-piece handgrip to the frame without having to modify the frame.

The factory-supplied handgrip is of one-piece construction and the two sides of the unitary plastic handgrip were connected by a portion that extends around the back part of the handgrip. Each of the sides includes a depressed lug that slips into an opening in the frame of the gun, and unitary plastic handgrip is secured to the frame in this position by a pin located at the lower rear portion of the handgrip. Thus, unlike certain other models of hand gun, the frame of this particular model does not include a threaded hole for receiving a screw that can be used to attach the two halves of a two-piece handgrip. Accordingly, until the present invention, it was difficult or impossible to apply customized two-piece handgrip to this particular model of gun.

SUMMARY OF THE INVENTION

In accordance with the present invention, an accessory is provided that makes it possible to replace the unitary plastic handgrip supplied by the factory with a customized two-piece handgrip. The accessory replaces a part of the unmodified gun and in addition provides a threaded hole so that screws may be used to secure the halves of a two-piece handgrip to the hand gun.

As in the factory-supplied grip, lugs located at the upper front end of each half of the two-piece handgrip slide beneath a portion of the frame in that area, and thereafter, the lower rear portions of the halves are secured to the frame by screwing them to the accessory, which fits snugly within the frame and which is secured therein by a pin.

The novel features which are believed to be characteristic of the invention, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
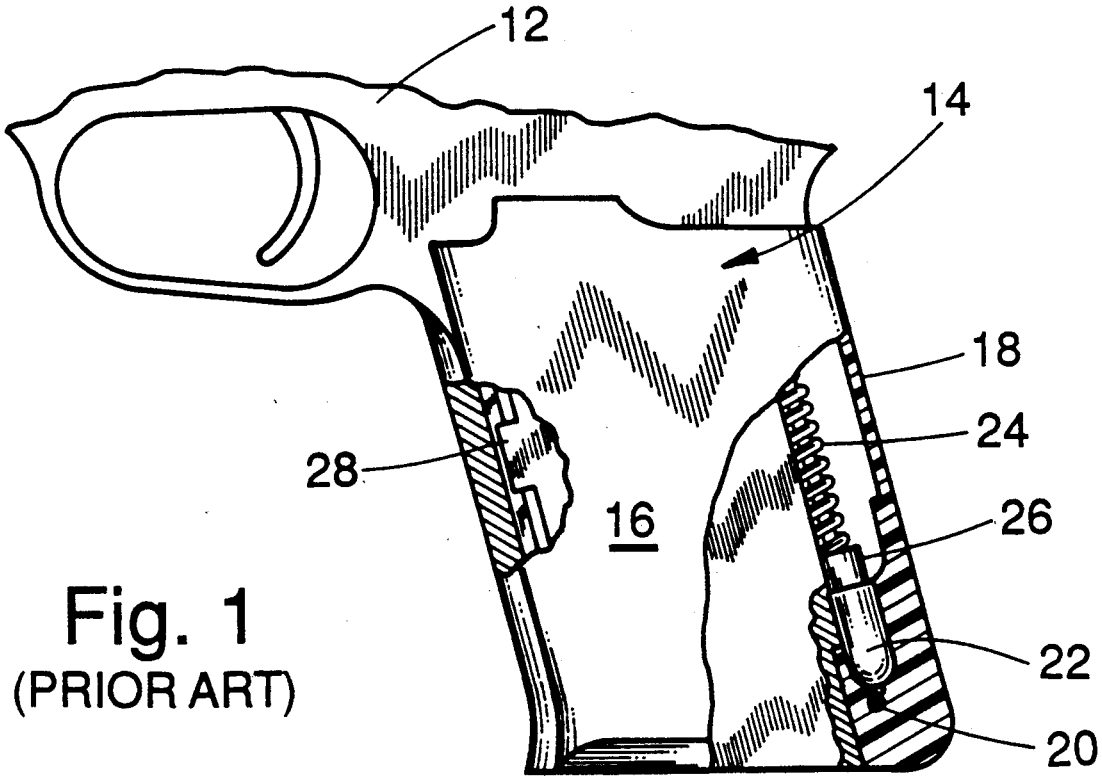
Fig. 1 (PRIOR ART)
FIG. 1 is a side elevational view partially cut away to show the manner in which the unitary one-piece handgrip of the prior art was secured to the frame of the hand gun.

FIG. 1 shows how the one-piece handgrip 14 of the prior art is secured to the frame 12 of the hand gun. The one-piece handgrip 14 includes a side portion 16 that is connected to a similar side portion on the other side of the gun by an intermediate portion 18 that extends around the rear portion of the frame to connect the two side portions. The intermediate portion 18 is secured to the frame by the pin 20 and includes a socket 22 for receiving a cup 26 that receives the main spring 24 of the gun. The front end of the side portion 16 includes a lug 28 that slides beneath a portion of the frame 12 to retain the side portion to the frame in that area. Thus, when the factory-supplied one-piece handgrip 14 is removed from the frame, not only is there no means remaining of attaching separate side portions to the frame, but in addition, the gun is rendered inoperable due to the absence of the socket 22 to receive the end of the main spring 24 which must be compressed to operate the gun.

Figure 2:
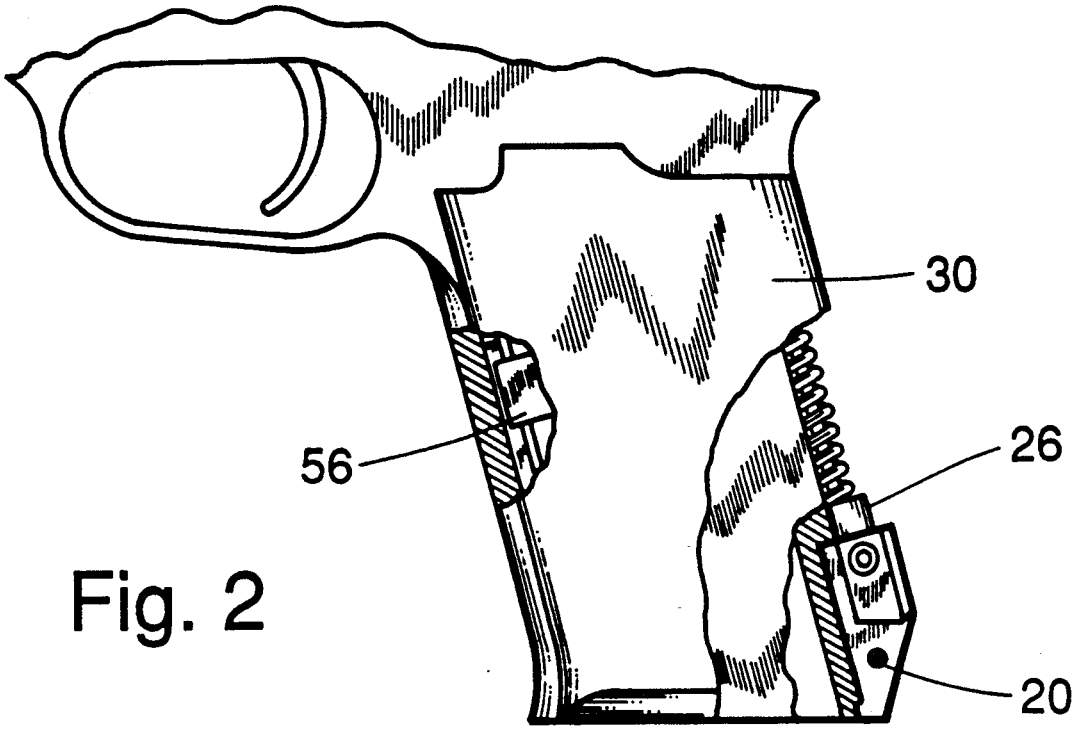
FIG. 2 is a side elevational view showing a preferred embodiment of the present invention and partly cut away to show the manner in which the halves of the two-piece handgrip are secured to the frame of the gun.
Figure 3:
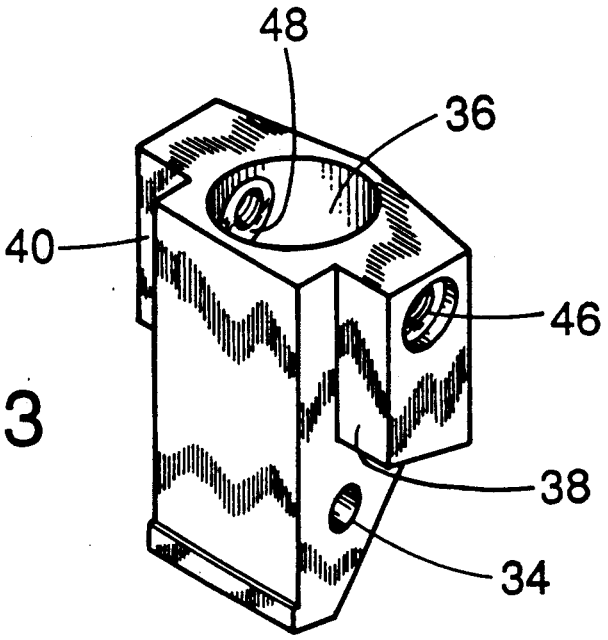
FIG. 3 is a perspective view showing an accessory used in the preferred embodiment of the invention to join the halves of the handgrip to the frame of the gun; and, FIG. 4 is a exploded rear elevational view showing how the halves of the handgrip are joined to the frame of the gun in the preferred embodiment.
Figure 4:
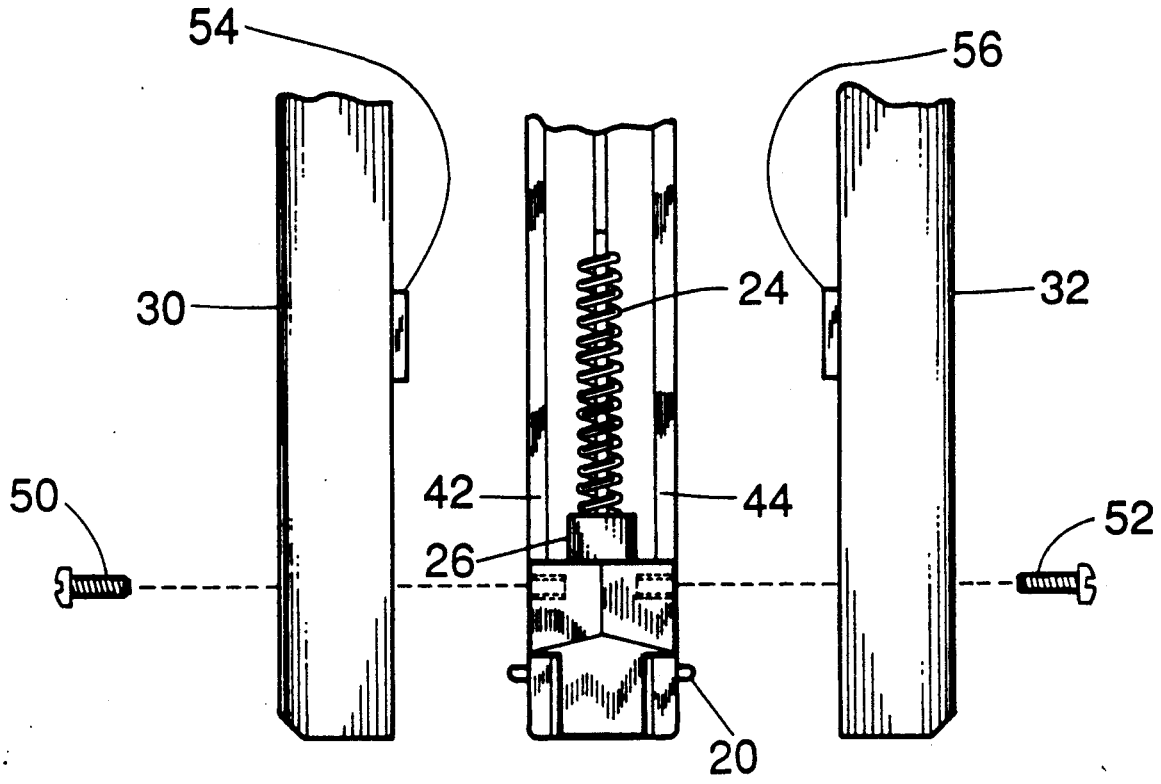

The present inventory has found a way around this problem that permits the use of a handgrip consisting of two separate side pieces, of which the side piece 30 of FIG. 2 is typical. FIGS. 2, 3 and 4 show how the two side pieces are attached to the frame 12 of the gun.

The most novel aspect of the present invention is the accessory shown in FIG. 3 which is used for joining the two halves 30 and 32 of the two-piece grip to the frame 12. The accessory of FIG. 3 includes a laterally extending hole 34 for the pin 20, an inclined socket 36 for receiving the cup 26 that covers the lower end of the main spring 24, and forwardly facing surfaces 38, 40 that bear against portions 42 44 of the frame 12 to prevent rotation of the accessory about the pin 20.

In addition to the hole 34 and the socket 36, the accessory of the present invention includes two laterally extending threaded holes 46, 48 for receiving screws 50, 52 for the purpose of retaining the halves 30, 32 of the two-piece handgrip to the frame 12.

In the preferred embodiment, the halves 30, 32 include lugs 54, 56 that, like the lug 28, slide under a portion of the frame 12 to retain the halves to the frame at their front ends.

In the preferred embodiment, the accessory of FIG. 3 is molded of plastic, and the threaded portion of the threaded holes 46, 48 is provided in the form of a metallic insert.

Thus, there has been described an accessory that permits replacement of the one-piece standard plastic handgrip supplied by the factory with a personally-selected two-piece handgrip.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An accessory that permits replacement of a one-piece standard plastic handgrip by a personally-selected two-piece handgrip, said one-piece standard plastic handgrip secured to a frame of a gun by a laterally-extending pin and including an inclined socket for retaining one end of a main spring, said accessory comprising:

a block including a laterally-extending hole sized to accept the laterally-extending pin, an inclined socket for retaining the end of the main spring, and further including laterally-extending threaded holes for receiving screws that are used for securing the two pieces of the personally-selected two-piece handgrip to the frame of the gun.

2. The accessory of claim 1 wherein said block further comprises inclined forwardly-facing surfaces that bear against the frame of the gun, whereby said block is secured at a desired orientation with respect to the frame of the gun.

* * * * *